US011700941B2

(12) United States Patent
Cowman-Eggert

(10) Patent No.: US 11,700,941 B2
(45) Date of Patent: Jul. 18, 2023

(54) RESIZABLE FURNITURE PADS

(71) Applicant: 3M INNOVATIVE PROPERTIES COMPANY, St. Paul, MN (US)

(72) Inventor: Christina D. Cowman-Eggert, Inver Grove Heights, MN (US)

(73) Assignee: 3M Innovative Properties Company, St. paul, MN (US)

( * ) Notice: Subject to any disclaimer, the term of this patent is extended or adjusted under 35 U.S.C. 154(b) by 21 days.

(21) Appl. No.: 16/967,344

(22) PCT Filed: Feb. 5, 2019

(86) PCT No.: PCT/IB2019/050913

§ 371 (c)(1),
(2) Date: Aug. 4, 2020

(87) PCT Pub. No.: WO2019/150345

PCT Pub. Date: Aug. 8, 2019

(65) Prior Publication Data

US 2020/0352329 A1 Nov. 12, 2020

Related U.S. Application Data

(60) Provisional application No. 62/626,442, filed on Feb. 5, 2018, provisional application No. 62/626,519, filed on Feb. 5, 2018.

(51) Int. Cl.
*A47B 91/06* (2006.01)
*A47B 91/02* (2006.01)
(Continued)

(52) U.S. Cl.
CPC ..... *A47B 91/06* (2013.01); *A47B 91/02* (2013.01); *A47B 91/04* (2013.01); *A47B 91/12* (2013.01); *A47B 2091/063* (2013.01)

(58) Field of Classification Search
CPC ..... A47B 91/04; A47B 91/02; A47B 91/06; A47B 91/12; A47B 2091/063
See application file for complete search history.

(56) References Cited

U.S. PATENT DOCUMENTS 273,885 A * 3/1883 Pelton ..... A47B 91/04 16/108
2,030,699 A * 2/1936 Herold ..... A47B 91/04 16/42 R
(Continued)

FOREIGN PATENT DOCUMENTS

CA 2672372 1/2011
CN 202981005 U 6/2013
(Continued)

OTHER PUBLICATIONS

Home Depot Everbilt, Dec. 30, 2015, https://www.homedepot.com/p/Everbilt-Assorted-Beige-Heavy-Duty-Self-Adhesive-Strips-Round-and-Rectangular-Felt-Furniture-Pads-Value-Pack-27-Piece-49947/203 (Year: 2015).*
(Continued)

*Primary Examiner* — Jeffrey O'Brien
(74) *Attorney, Agent, or Firm* — Ann K. Gallagher

(57) ABSTRACT

The present disclosure provides furniture pads having multiple segments that can coupled and decoupled to accommodate a desired size. The pads include a body of a protective material, with an inner segment and a first outer segment. The inner segment has at least one smaller cross-sectional dimension than the outer segment. Additional outer segments can have progressively increasing cross-sectional dimensions such that the all resulting segments are nested.

9 Claims, 4 Drawing Sheets

(51) Int. Cl.
*A47B 91/04* (2006.01)
*A47B 91/12* (2006.01)

(56) References Cited

U.S. PATENT DOCUMENTS

| | | | | | |
|---|---|---|---|---|---|
| 3,138,893 | A * | 6/1964 | Rupar | A47B 91/12 | 248/346.11 |
| 4,472,480 | A | 9/1984 | Olson | | |
| 4,726,982 | A | 2/1988 | Traynor | | |
| 4,736,048 | A | 4/1988 | Brown | | |
| 4,980,443 | A | 12/1990 | Kendziorski | | |
| 5,082,706 | A | 1/1992 | Tangney | | |
| 5,680,673 | A * | 10/1997 | Beshore | A47C 7/002 | 16/42 T |
| 5,743,506 | A * | 4/1998 | Adams | A47B 91/00 | 248/346.11 |
| 5,802,669 | A * | 9/1998 | Wurdack | A47B 91/002 | 16/42 R |
| 5,965,256 | A | 10/1999 | Barrera | | |
| 6,403,206 | B1 | 6/2002 | Bries | | |
| 6,572,945 | B2 | 6/2003 | Bries | | |
| 6,586,071 | B1 * | 7/2003 | Hanes | B32B 5/00 | 428/101 |
| 6,626,405 | B1 | 9/2003 | Keast | | |
| 6,730,397 | B2 | 5/2004 | Melancon | | |
| 6,866,913 | B2 * | 3/2005 | Hanes | B32B 5/00 | 428/101 |
| 6,972,141 | B1 | 12/2005 | Bries | | |
| 7,086,400 | B2 | 8/2006 | Shigematsu | | |
| 7,781,056 | B2 | 8/2010 | Bries | | |
| 9,826,835 | B1 | 11/2017 | Carpinella | | |
| 9,894,995 | B2 * | 2/2018 | Downs | A47B 91/02 | |
| 2002/0182369 | A1 * | 12/2002 | Hanes | B32B 5/02 | 428/101 |
| 2005/0003723 | A1 | 1/2005 | Brouard | | |
| 2005/0081330 | A1 | 4/2005 | Edwards | | |
| 2005/0137375 | A1 | 6/2005 | Hansen | | |
| 2005/0205749 | A1 * | 9/2005 | Campbell | A47B 91/04 | 248/633 |
| 2008/0042025 | A1 * | 2/2008 | Brouard | A47B 91/06 | 248/188.9 |
| 2008/0099639 | A1 * | 5/2008 | Webster | A47B 91/06 | 248/188.9 |
| 2008/0280102 | A1 * | 11/2008 | Brouard | A47B 91/06 | 428/141 |
| 2010/0018005 | A1 | 1/2010 | Bushey | | |
| 2012/0064338 | A1 * | 3/2012 | Niimi | C09J 7/20 | 428/354 |
| 2012/0241569 | A1 * | 9/2012 | Downs | A47B 97/00 | 248/188.9 |
| 2013/0213414 | A1 | 8/2013 | Park | | |
| 2014/0335299 | A1 | 11/2014 | Wang | | |
| 2016/0157608 | A1 | 6/2016 | Gergonne | | |
| 2017/0224113 | A1 * | 8/2017 | Heege | A47B 91/12 | |

FOREIGN PATENT DOCUMENTS

| | | | |
|---|---|---|---|
| CN | 203244139 | U | 10/2013 |
| CN | 204260224 | U | 4/2015 |
| EP | 1529464 | | 5/2015 |
| FR | 2637794 | | 4/1990 |
| FR | 2711900 | | 1/1996 |
| FR | 2868673 | | 10/2005 |
| FR | 2983770 | | 6/2013 |
| FR | 2988276 | | 9/2013 |
| FR | 2990610 | | 11/2013 |
| JP | 2004154293 | | 6/2004 |
| JP | 3158500 | U | 4/2010 |
| KR | 1019940025589 | | 12/1994 |
| KR | 1020090095857 | | 9/2009 |
| TW | 510102 | U | 10/2015 |
| WO | WO 2009-150409 | | 12/2009 |
| WO | WO 2019-150347 | | 8/2019 |

OTHER PUBLICATIONS

International Search Report for PCT International Application No. PCT/IB2019/050913, dated Apr. 8, 2019, 4 pages.

Wood Floor Protectors by Metric USA: "Wood floor protector," Youtube, Aug. 25, 2015, p. 1. Retrieved from the internet: https://www.youtube.com/watch?v=wOZH6Ux7nS8.

Metric USA (Amazon): Furniture Pads, Furniture Feet Set of 8, 4 Inches Square or Round 3/16 Inches Thick Wood Floor Protectors, 7 pages, retrieved Sep. 23, 2021, from https://www.amazon.com/Wood-Floor-Protectors-Metric-USA/dp/B0123KWF4S.

Amazon: Happykiddos Foam Puzzle Play Mats, 10 pages, retrieved May 16, 2017 from https://www.amazon.de/Happykiddoos-Puzzlespielmatte-Schaumstoff-Verriegelung-Kinderteppich/dp/B072BWXMW3/ref=sxin_15?_mk_de_DE=%C3%85M%C3%85Z%C3%95%C3%91&asc_contentid=amzn1.osa.91dc0382-5846-4d91-b1da-54a491d4c656.A1PA6795UKMFR9.de_DE&asc_contenttype=article&ascsubtag=amzn1.osa.91dc0382-5846-4d91-b1da-54a491d4c656.A1&th=1.

* cited by examiner

RESIZABLE FURNITURE PADS

CROSS REFERENCE TO RELATED APPLICATIONS

This application is a national stage filing under 35 U.S.C. 371 of PCT/IB2019/050913, filed Feb. 5, 2019, which claims the benefit of provisional Application No. 62/626,442, filed Feb. 5, 2018, and also claims the benefit of provisional Application No. 62/626,519, filed Feb. 5, 2018, the disclosure of which is incorporated by reference in its/their entirety herein.

SUMMARY

Protecting a floor from markings caused by contacting furniture has traditionally been accomplished with felt or plastic pads. While generally satisfactory for their purpose, each has been associated with its share of problems. The bases of chair legs and other furniture feet come in a variety of different sizes and shapes and may be tapered, angled, or hollow, making application of a normal felt pad difficult or unsightly. In addition, many tables and chairs come with a small polypropylene or other plastic disc screwed into the wooden or metal leg of the chair to act as a surface protector. If felt pads are to be used with these furniture items, the felt pads must either be resized to fit the small dimensions of the disc or be designed to fit around the disc.

The inventors of the present disclosure recognized that the existing furniture pads could be improved or enhanced by introducing separable sections into the felt pad; sections can be removed to mount the felt pad around the disc or other projection, or to use the smallest section to fit directly over the disc. The ability to change the size and shape of the felt pad without cutting tools or excess user effort also allows for better application on furniture with angled legs or atypically-shaped bases.

In one aspect, the present disclosure provides a furniture pad comprising a body including a protective material and having an inner segment and a first outer segment. The inner segment has at least one smaller cross-sectional dimension than the outer segment. Additional outer segments can have progressively increasing cross-sectional dimensions such that the resulting segments are nested.

As used herein, "layer" means a single stratum that may be continuous or discontinuous over a surface.

As used herein, the terms, "height", "depth", "top" and "bottom" are for illustrative purposes only, and do not necessarily define the orientation or the relationship between the surface and the intrusive feature. Accordingly, the terms "height" and "depth", as well as "top" and "bottom" should be considered interchangeable.

The terms "comprises" and variations thereof do not have a limiting meaning where these terms appear in the description and claims.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As recited herein, all numbers should be considered modified by the term "about".

As used herein, "a", "an", "the", "at least one", and "one or more" are used interchangeably. Thus, for example, a core comprising "a" pattern of recesses can be interpreted as a core comprising "one or more" patterns.

Also herein, the recitations of numerical ranges by endpoints include all numbers subsumed within that range (e.g., 1 to 5 includes 1, 1.5, 2, 2.75, 3, 3.80, 4, 5, etc.).

As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, strictly, and the like, are understood to be within the usual tolerances or measuring error applicable to the particular circumstance rather than requiring absolute precision or a perfect match.

The above summary of the present disclosure is not intended to describe each disclosed embodiment or every implementation of the present invention. The description that follows more particularly exemplifies illustrative embodiments. In several places throughout the application, guidance is provided through lists of examples, which examples can be used in various combinations. In each instance, the recited list serves only as a representative group and should not be interpreted as an exhaustive list.

Layers in certain depicted embodiments are for illustrative purposes only and are not intended to absolutely define the thickness, relative or otherwise, or the absolute location of any component. While the above-identified figures set forth several embodiments of the disclosure other embodiments are also contemplated, as noted in the description. In all cases, this disclosure is presented by way of representation and not limitation. It should be understood that numerous other modifications and embodiments can be devised by those skilled in the art, which fall within the scope and spirit of the principles of the disclosure.

DETAILED DESCRIPTION

Various embodiments and implementations will be described in detail. These embodiments should not be construed as limiting the scope of the present application in any manner, and changes and modifications may be made without departing from the spirit and scope of the inventions. Further, only some end uses have been discussed herein, but end uses not specifically described herein are included within the scope of the present application. As such, the scope of the present application should be determined by the claims.

Figure 1:
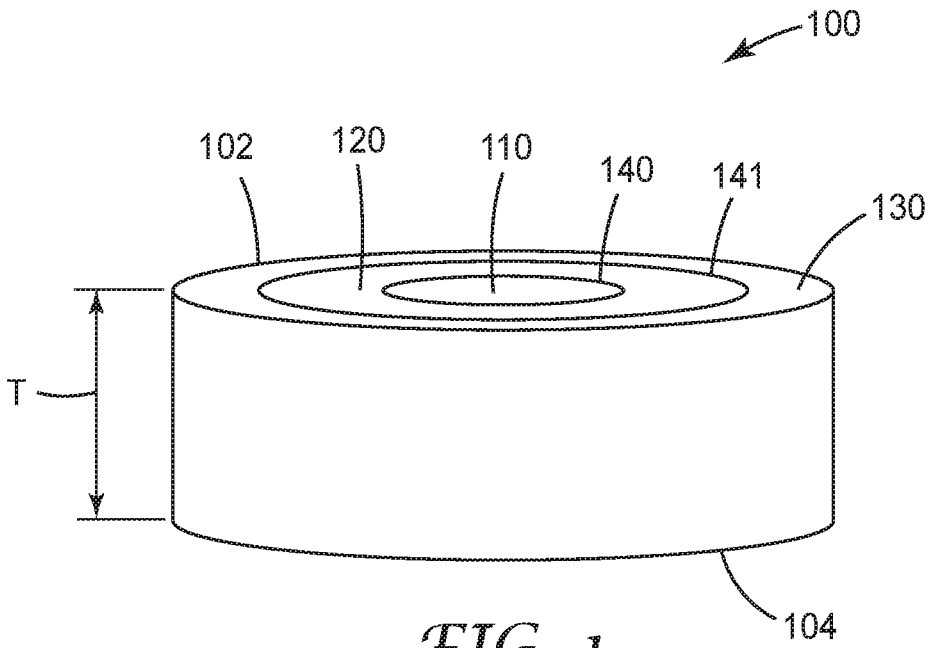
FIG. 1 is a perspective view of one embodiment of an exemplary furniture pad of the type generally described herein.
Figure 2:
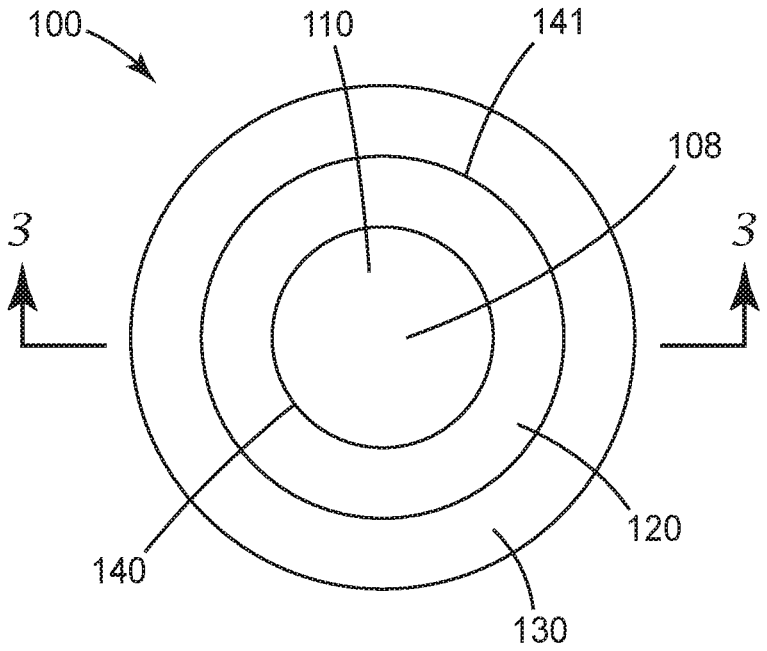
FIG. 2 is a top plan view of the pad of FIG. 1.
Figure 3:
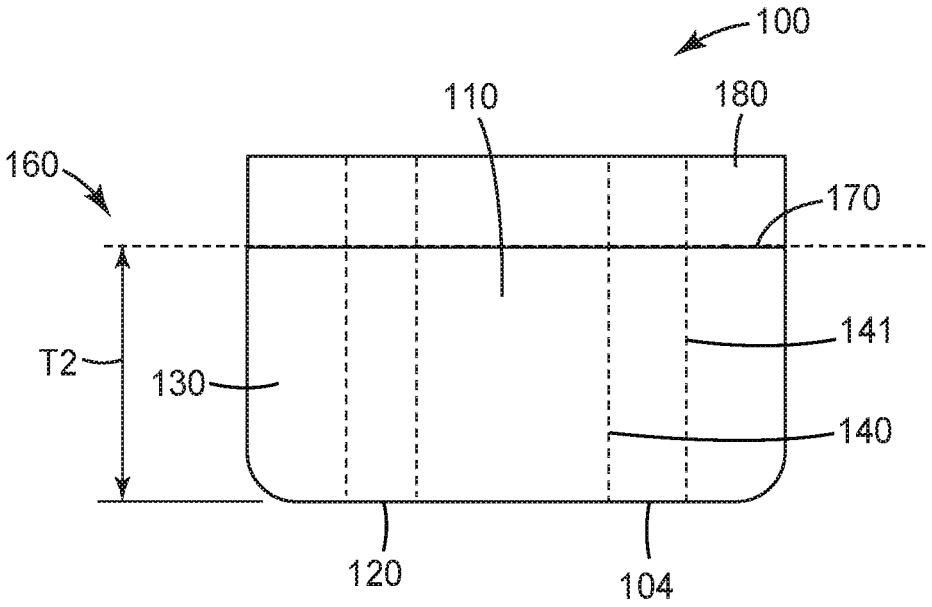
FIG. 3 is a cross-sectional view of the pad of FIGS. 1 and 2.

FIGS. 1-3 depict an exemplary embodiment of a furniture pad 100 as generally described herein. The furniture pad 100 includes an attachment surface 102 on the top major surface and a protective surface 104 at the base of the pad. The protective surface 104 may be substantially planar or have curved edges to reduce drag or wear on certain floor substrates. The furniture pad 100 includes a first pad segment 110, a second pad segment 120, and a third pad segment 130. The individual pad segments 110, 120, 130 are arranged as concentric ring that defines the body of the furniture pad 100.

As seen in FIG. 1, the pad 100 has a generally circular or disc shape. The shape of the pad 100 is not particularly limited, however, and can include any suitable shape or combination of shapes. In some embodiments, for instance, the pad 100 can be rectangular (which includes a square) and each pad segment can have a rectangular cross-sectional shape. Other shapes and combinations of shapes are contemplated for use amongst different categories of furniture. As used herein, the cross-sectional shape of a pad or pad segment is identified in a plane generally parallel to the attachment surface 102 of the pad 100.

The pad 100 is made from a protective material adapted to prevent wear on flooring and/or space a leg from the ground. The protective material is designed to lie between a furniture leg and the floor to prevent scratching or wear on the floor as the furniture leg rests or moves along the floor surface (See, e.g., FIG. 4 below).

The protective material typically includes felt, woven or knitted fabric or cloth, scratch-resistant material such as polytetrafluoroethylene (PTFE), polypropylene or polyethylene, or other resilient materials such as rubber, nonwovens, and foam. The felt, cloth, and nonwovens may be made using any size fibers or fibers made from any material known in the art. Fibers used in felt or nonwovens may be derived from biological sources such as linen or wool. Felt or nonwovens may be made using synthetic fibers including but not limited to polyethylene terephthalate (PET), polyethylene, polypropylene, nylon, or other polyesters. Felt or nonwovens made from biological sources may also be used either alone or in combination with other fibers made from synthetic materials such as polyethylene, polypropylene, polyethylene terephthalate (PET), nylon, or other polyester fibers. The fibers may or may not be reinforced using additives such as microspheres or polymer resin or reinforced using thermal treatments. Single layer combinations of the above materials such as nonwovens or fabric reinforced with polymer resins are also anticipated. The protective material may be a single continuous layer of material, or may include multiple materials arranged in one or more layers. For example, a protective element may include a scrim or shock absorbing element, as described in European Patent No. EP1529464.

In the embodiment of FIGS. 1 & 3, the pad includes a single layer of material having a thickness "T", though multilayer or multi-material constructions are also contemplated as described above. In some embodiments, the material has a thickness "T" of between about 2 mils and about 100 mils. In some embodiments, the material has a thickness of greater than 35 mils. In some embodiments, the pad has a thickness of greater than 110 mils.

The protective surface 104 of the pad 100 may be coated with a layer of a low friction material, such as polyethylene, polypropylene, nylon, polytetrafluoroethylene (PTFE), polyoxymethylene and mixtures thereof.

The pad may be provided with a release liner on at least one of the attachment and protective surfaces 102, 104. Examples of suitable liners include paper, e.g., kraft paper, or polymeric films, e.g., polyethylene, polypropylene or polyester. At least one surface of the liner can be treated with a release agent such as silicone, a fluorochemical, or other low surface energy based release material to provide a release liner. Suitable release liners and methods for treating liners are described in, e.g., U.S. Pat. Nos. 4,472,480, 4,980,443 and 4,736,048, and incorporated herein. The release liners can be printed with lines, brand indicia, or other information.

The pad segments 110, 120, 130 making up the pad 100 are arranged in a concentric manner and feature the same cross-sectional shape as the pad 100. Each pad segment 110, 120, 130 includes the same circular shape, with each having a different dimension than the adjacent segment(s). The inner pad segment 110 includes the smallest circumference at the center 108 of the pad, with outer pad segments 120, 130 increasing in circumference in relation to the radial displacement of the segment from the center 108. In the depicted arrangement, the inner pad segment 110 is a solid body, while the outer segments 120, 130 are hollow and encircle the inner segment 110. Of course, inner pad segment 110 may also be provided as a ring, leaving no material at and surrounding the center 108 of the pad 100.

While the depicted embodiments include pad segments 110, 120, 130 having the same thickness, other configurations of pad according to the present disclosure may include inner and outer segment having disparate thickness. Similarly, the pad segments may be formed of the same protective material(s), or possess different protective materials. For example, the inner pad segment 110 can include a resilient plastic material, while one or both of the outer pad segments include a fibrous material.

The pad segments each include a top major surface and a bottom major surface. These opposing major surfaces collectively define the attachment surface 102 and protective surface 104 of the pad 100. As depicted, the major surfaces of each pad segment 110, 120, 130 are substantially coplanar. In other alternative embodiments, including those of pad segments having different thicknesses, any one of the pad segments may lie in a plane substantially above or below one or more of the other segments Though pad 100 as depicted includes three distinct pad segments 110, 120, 130, those skilled in the art will appreciate that the furniture pads of the present disclosure can include more or fewer pad bodies as desired. For instance, it may be possible to realize at least some of the certain benefits of the disclosure with two pad segments. In presently preferred implementations, however, the furniture pad includes three or more pad segments.

The pad body segments 110, 120, 130 may be separated or separable. Separation paths 140, 141 extend between the adjoining pad segments and define the outer periphery of each individual segment. The separation paths 140, 141 extend through at least a portion of the thickness "T" of the pad protective material, in a direction generally orthogonal to a plane 160 defined by the top surface 170 of the protective material body. This allows the pad segments to be separated and used without modifying the thickness of the resulting pad.

If separated, the pad body segments are provided for use already discrete from one another along the relevant separation path 140, 141. In such embodiments, the separation paths 140, 141 can be die cut, laser cut, or other methods available in the art for segmenting materials. In some embodiments where a pad surface 102, 104 includes a release liner, the separation paths may be cut through the protective material only, leaving the release liner intact according to so-called kiss cutting techniques described, for example, in US Publication No. 2016/0157608.

If made separable, the pad body segments may be initially coupled along separation paths 140, 141. Therefore, each pad segment 110, 120, 130 may be individually detached from either one or both adjoining pad segments.

Each separation path 140, 141 may comprise at least one of a perforation or set of perforations, a thinned portion, at least one shaped recess, and other configurations or combinations thereof known in the art. The separation paths 140, 141 may be provided with a single line of weakness as depicted, or can include a plurality of lines of weakness. If perforations are used, the perforations may be shaped in accordance with any perforation pattern including linear, angled, Y-shaped, V-shaped, dual-angled offset, sinusoidal, etc. The separation paths 140, 141 may for example comprise a hole or slit, or several holes or slits extending through the thickness "T" of the protective material. The separation paths 140, 141 may be continuous and provided by a single continuous feature, or discontinuous and provided by a multiplicity of features acting in combination. The separation paths 140, 141 may further include one or more layers of an adhesive, gel, or gel adhesive bound by covalent bonding, ionic bonding, hydrogen bonding, and/or van der Waals forces disposed between the segments.

It will be appreciated that in some embodiments the design of the separation paths 140 can differ between the first and second, as well as second and third pad segments. Thus, for example, separation path 141 between the outer pad segments 120, 130 may be designed to more easily initiate and/or propagate a tear, in comparison to the separation path 140 between the inner pad segment and the first outer pad segment 120. For example, separation path 141 may be a continuous recess, while separation path 140 might be a discontinuous series of perforations spaced at a greater pitch.

Attachment of the pad 100 to the furniture can be achieved with a layer of adhesive 180 on the top surface 170 of the protective material (see FIG. 3, as the adhesive is not shown in FIG. 1). Alternatively, the pad may be attached by traditional mechanical fasteners (e.g., a screw or a nail), or a detachable connector, such as a hook and loop connections. A presently preferred attachment mechanism can provide sufficient strength along the general plane of its separation so that, depending on the specific application, the mechanism will not fail based on the use or movement of the furniture pad 100. The attachment can provide an internal static shear strength in a direction parallel to the general plane for supporting the object during movement and providing a level of resiliency to the pad 100.

A detachable connector permits the separation and connection of the furniture pad to the furniture leg along a general plane. In some embodiments, the detachable connector can include, for example, a mechanical type fastener including an interlocking system, an intermeshing system having connection without macroscopic mechanical deformation or interference, a releasable contact responsive fastener, a splittable construction, a magnetic connection, and the like.

In some embodiments, the attachment mechanism for the furniture pad includes an adhesive. In some embodiments, the adhesive includes a pressure-sensitive adhesive. A general description of useful pressure sensitive adhesives may be found in the Encyclopedia of Polymer Science and Engineering, Vol. 13, Wiley-Interscience Publishers (New York, 1988). Additional description of useful pressure-sensitive adhesives may be found in the Encyclopedia of Polymer Science and Technology, Vol. 1, Interscience Publishers (New York, 1964). Pressure sensitive adhesive compositions are well known to those of ordinary skill in the art to possess properties including the following: (1) tack, (2) adherence with no more than finger pressure, (3) sufficient ability to hold onto an adherend, and (4) sufficient cohesive strength to be cleanly removable from the adherend. Materials that have been found to function well as pressure sensitive adhesives are polymers designed and formulated to exhibit the requisite viscoelastic properties resulting in a desired balance of tack, peel adhesion, and shear holding power. Suitable PSAs may be based on crosslinked or non-crosslinked (meth)acrylics, rubbers, thermoplastic elastomers, silicones, polyurethanes, and the like, and may include tackifiers in order to provide the desired tack, as well as other additives. In some embodiments, the PSA is based on a (meth)acrylic PSA or at least one poly(meth)acrylate, where (meth)acrylate refers to both acrylate and methacrylate groups. In some embodiments, the PSA is an olefin block copolymer based adhesive. In some embodiments, the PSA is an adhesive based on styrenic block copolymers or copolymers of styrene and hydrogenated, partially hydrogenated, or non-hydrogenated dienes such as butadiene or isoprene. Acrylic based pressure sensitive adhesives are described in U.S. Pat. No. 4,726,982 (Traynor et al.) and in U.S. Pat. No. 5,965,256 (Barrera), for example. Silicone based pressure sensitive adhesives are described in U.S. Pat. No. 6,730,397 (Melancon et al.) and U.S. Pat. No. 5,082,706 (Tangney), for example. Polyurethane based pressure sensitive adhesives are described in U.S. Pat. Appl. Pub. No. 2005/0137375 (Hansen et al.), for example. Olefin block copolymer based pressure sensitive adhesives are described in U.S. Pat. Appl. Pub. No. 2014/0335299 (Wang et al.), for example. In other embodiments, the adhesive includes a single or two-part epoxies or liquid adhesive.

The adhesive 180 can be single layer or multilayer. Adhesive layers can be the same as one another or disparate from one another. Disparate, in this context, is used to describe substantial differences in composition or adhesive performance. Adhesive layers can each be a single layer or can be multilayer. Adhesive layers can each be continuous or discontinuous (e.g., patterned) across the major surfaces of the protective material. In some embodiments, the adhesive layer can include an adhesive/release liner stack as described in co-filed provisional patent application, entitled MULTI-LAYER, RESTORABLE PROTECTIVE FURNITURE PADS and incorporated by reference in its entirety herein.

Generally, any known additives useful in the formulation of adhesives may also be included in an adhesive based detachable interface. Additives include plasticizers, anti-aging agents, ultraviolet stabilizers, colorants, thermal stabilizers, anti-infective agents, fillers, crosslinkers, as well as mixtures and combinations thereof. In certain embodiments, the adhesive can be reinforced with fibers or a fiber scrim which may include inorganic and/or organic fibers. Suitable fiber scrims may include woven-, non-woven or knit webs or scrims. For example, the fibers in the scrim may include wire, ceramic fiber, glass fiber (for example, fiberglass), and organic fibers (for example, natural and/or synthetic organic fibers).

In some embodiments, the attachment mechanism can include a layer of hook material which is bonded with or otherwise attached to the protective material at a top major surface thereof. The hook material may interlock with a layer of loop material which is bonded to a bottom major surface of the furniture. It is contemplated that any commercially available hook and loop connector system, including those available from 3M Company, can be utilized. Hook and loop connector systems are but one type of mechanical interlocking connector systems which are suggested by this embodiment. By mechanical interlocking, it is meant those fasteners where at least one of the connector elements undergoes some macroscopic deformation (preferably plastic deformation) so that a mechanical interference results between plural components. Many different modifications of the inter-engaging elements are designed based on the requisite force and manner of separation between the cooperating layers of such a separable connector system. Some exemplary separable connectors are described in, for example, U.S. Pat. Nos. 6,572,945; 7,781,056; 6,403,206; and 6,972,141, all of which are incorporated by reference in their entirety herein.

The furniture pads described herein may be attached or adhered, for example, to one or more legs of an article of furniture or may be attached to a table base or pedestal. When the furniture pad(s) are attached to a table base or pedestal, multiple furniture glides may be used. In addition, as known to those skilled in the art, the table base or pedestal may comprise multiple legs or prongs that each may have one or more furniture pads attached thereto.

Figure 4:
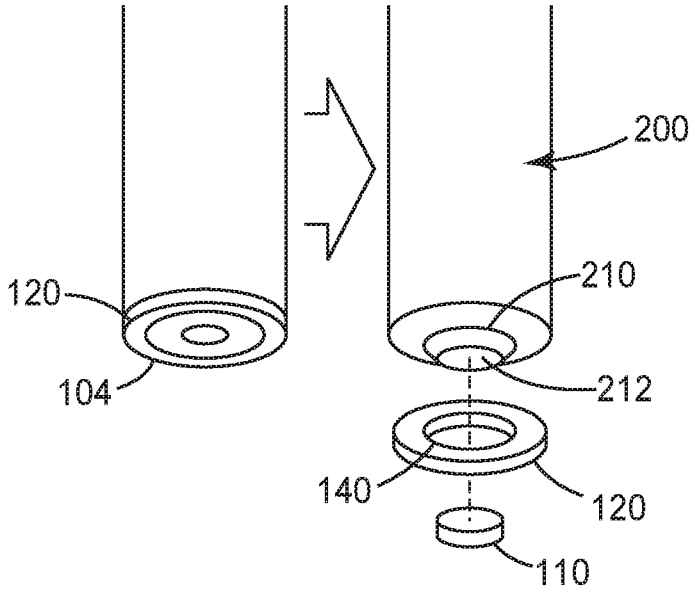
FIG. 4 is a depiction of the furniture pad of FIGS. 1-3 as applied and adjusted.

FIG. 4 depicts the removal of a pad body 110 from a furniture pad 100 coupled to a furniture leg 200 having a projecting disc 210. The pad includes an inner pad segment 110 and an outer segment 120. The inner pad segment 110 can be separated along separation path 140, resulting to two usable pad segments 110 and 120. Once the pad 100 is separated into multiple components, the user has two choices: 1) the outer pad 120 can be placed on leg 200 while surrounding the disc 210 and provide a protective surface 104 at least coplanar with the lower surface 212 of the disc; or 2) the inner pad segment can be placed directly on the lower surface 212 of the disc 210.

The furniture pad 100 (and any of the furniture pads contemplated herein) may be provided preassembled or as a modular kit of pad segments, allowing the user to select the precise number pad segments needed for a given object. The kit may include any number of pad segments of the same or different thicknesses. The modular kit can also allow a user to replace a worn or sullied pad body with a new version, or replace a failing interface. A release liner can be provided on any exposed adhesive or protective surface. The furniture pad 100 can also be provided and used as one of multiple stackable pad bodies, as described in co-filed provisional patent application, entitled MULTILAYER, RESTORABLE PROTECTIVE FURNITURE PADS and incorporated by reference in its entirety herein.

Figure 5:
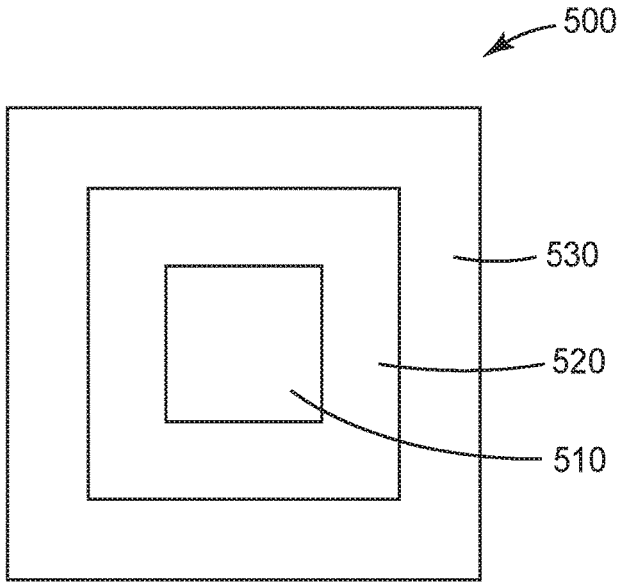
FIG. 5 is a top plan view of another embodiment of an exemplary furniture pad of the type generally described herein.
Figure 6A:
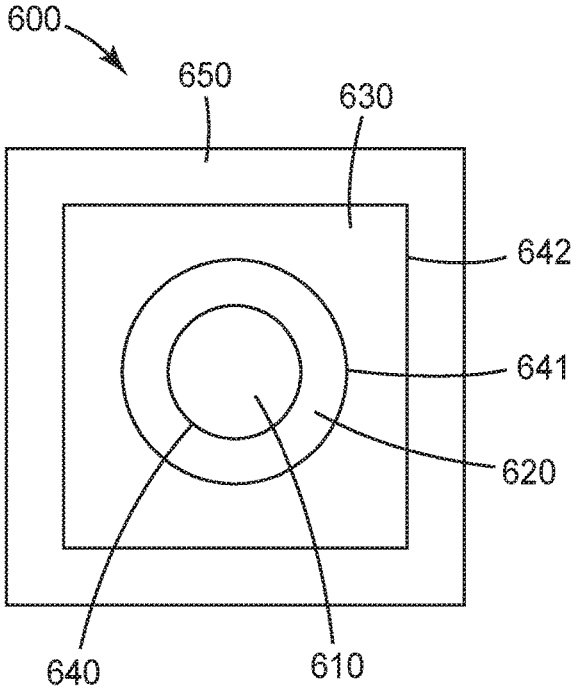
FIGS. 6A and 6B are top plan views of embodiments of exemplary furniture pads of the type generally described herein.
Figure 6B:
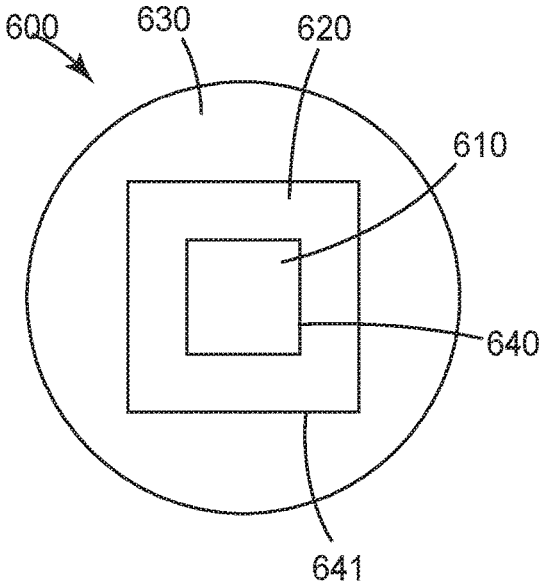

Though the embodiment of FIGS. 1-4 feature pad bodies having the same cross-sectional shape and concentrically arranged, other shapes and arrangements for contemplated for the furniture pad described herein. For example, FIG. 5 depicts a pad 500 featuring pad segments 510, 520, 530 having a square cross-sectional shape with linearly aligned centroids. As another alternative, FIGS. 6A and 6B depict pads 600 featuring a combination of cross-sectional shapes. Pad 600 of FIG. 6A includes two inner pad segments 610, 620 having a circular cross-sectional shape and two outer pad segments 630, 650 having a square cross-sectional shape. According, the inner separation paths 640, 641 are circular, and the outer separation path 642 is square. Conversely, the pad 600 of FIG. 6B includes two inner pad segments 610, 620 having a square cross-sectional shape and an outer pad segments 630 having a circular cross-sectional shape.

Figure 7:
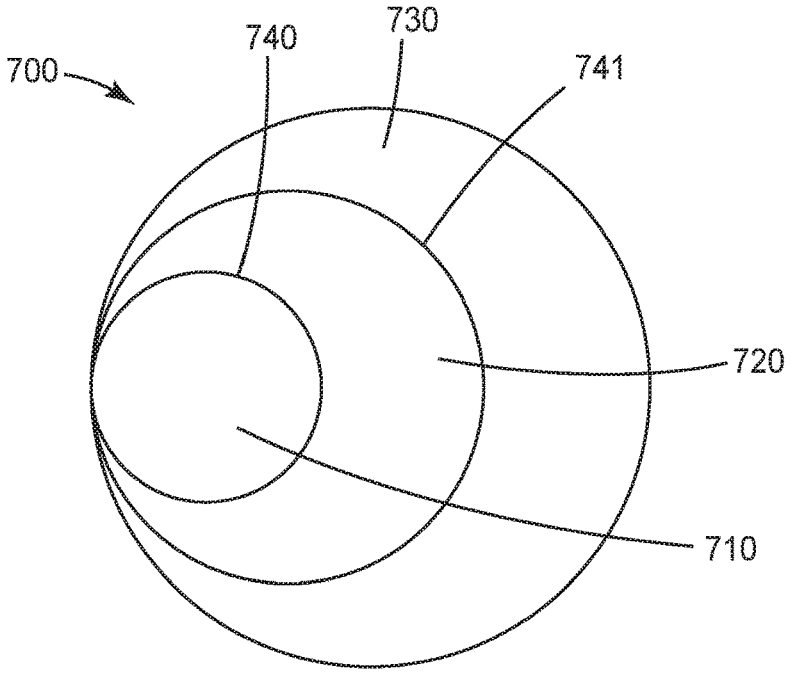
FIG. 7 is a top plan view of another embodiment of an exemplary furniture pad of the type generally described herein.

The pad 700 of FIG. 7 retains the same circular cross-sectional shapes for pad segments 710, 720, 730, but does not include concentric separation paths. Instead, the pad segments (and separation paths 740, 741) are arranged as coaxial circles.

Figure 8A:
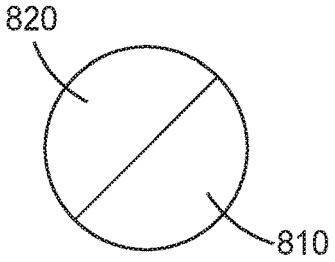
FIGS. 8A, 8B, and 8C are top plan views of embodiments of exemplary furniture pads of the type generally described herein.
Figure 8B:
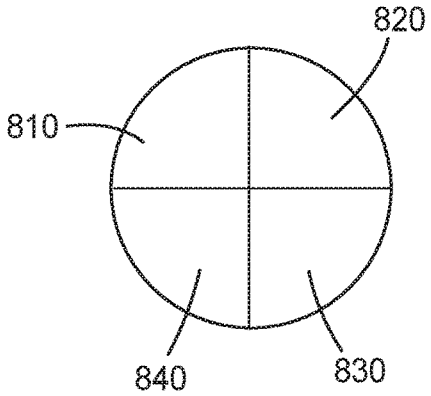
Figure 8C:
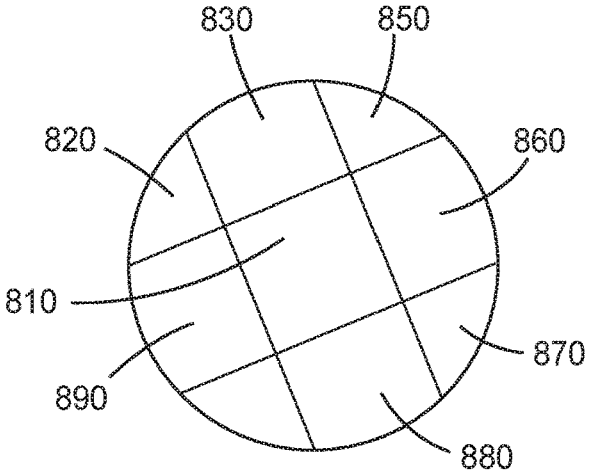

Of course, the pad segments may not be nested or collinear in certain embodiments. For example, the separation paths may divide the pad body 800 into a plurality of sectors 810, 820, etc. (See FIGS. 8A-8C), with a given separation path potentially overlapping with one or more additional separation paths.

In addition, it is also contemplated that furniture pads described herein can be applied to other legged objects, including appliances (washers, dryers, etc.) that also require leveling.

The furniture pads of the present disclosure may be manufactured according to any available technique, including those described in US Publication Nos. 2005/0003723 (Brouard et al.) and US2016/0157608 (Gergonne et al.).

The recitation of all numerical ranges by endpoint is meant to include all numbers subsumed within the range (i.e., the range 1 to 10 includes, for example, 1, 1.5, 3.33, and 10).

The patents, patent documents, and patent applications cited herein are incorporated by reference in their entirety as if each were individually incorporated by reference. It will be apparent to those of ordinary skill in the art that various changes and modifications may be made without deviating from the inventing concepts set from above. Thus, the scope of the present disclosure should not be limited to the structures described herein. Those having skill in the art will appreciate that many changes may be made to the details of the above-described embodiments and implementations without departing from the underlying principles thereof. Further, various modifications and alterations of the present invention will become apparent to those skilled in the art without departing from the spirit and scope of the invention. The scope of the present application should, therefore, be determined only by the following claims and equivalents thereof.

I claim:

1. A furniture pad configured to lie between a furniture leg and a floor to prevent scratching of the floor as the furniture leg is moved along the floor surface, the pad comprising:

a body including a protective material, a top surface defining a plane and an attachment surface, and a bottom surface opposing the top surface and defining a protective surface, wherein the body includes an inner segment, a first outer segment, and a second outer segment, wherein the inner segment has at least one smaller cross-sectional dimension than the first and second outer segments, wherein the inner segment is detachable from the first outer segment along a first separation path, wherein the first separation path extends through an entire thickness of the body in a direction generally orthogonal to the plane, wherein the first outer segment completely surrounds the inner segment, and wherein the first separation path defines an outer periphery of the inner segment, wherein the first outer segment is detachable from the second outer segment along a second separation path, wherein the second separation path extends through the entire thickness of the body in the direction generally orthogonal to the plane, wherein the second outer segment completely surrounds the inner segment and the first outer segment, and wherein the second separation path defines an outer periphery of the first outer segment.

2. The furniture pad of claim 1, wherein the segments are concentrically arranged.

3. The furniture pad of claim 1, wherein at least one of the segments includes a circular cross-sectional shape.

4. The furniture pad of claim 1, wherein at least one the segments includes a rectangular cross-sectional shape.

5. The furniture pad of claim 1, wherein the attachment surface includes one of a layer of adhesive and a separable connector.

6. The furniture pad of claim 5, wherein the separable connector includes at least one of a hook-loop connection, a micro-rail connection, and a magnetic connection.

7. The furniture pad of claim 1, and further including a release liner on a bottom surface of the protective material.

8. The furniture pad of claim 1, wherein the protective material is selected from felt, a woven fabric, rubber, non-woven, and foam.

9. The furniture pad of claim 1, wherein the protective material includes a scratch resistant plastic selected from the group consisting of PTFE, polypropylene, and polyethylene.

* * * * *